US008801157B2

(12) United States Patent
Freitag et al.

(10) Patent No.: US 8,801,157 B2
(45) Date of Patent: Aug. 12, 2014

(54) HEATED INK DELIVERY SYSTEM

(71) Applicant: Xerox Corporation, Norwalk, CT (US)

(72) Inventors: Chad David Freitag, Portland, OR (US); Pratima G. N. Rao, Sherwood, OR (US); Patricia A. Wang, Lake Oswego, OR (US); Tony R. Rogers, Milwaukie, OR (US); Bhaskar T. Ramakrishnan, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/863,628

(22) Filed: Apr. 16, 2013

(65) Prior Publication Data

US 2013/0229472 A1 Sep. 5, 2013

Related U.S. Application Data

(62) Division of application No. 12/700,413, filed on Feb. 4, 2010, now Pat. No. 8,469,497.

(51) Int. Cl.
*B41J 2/175* (2006.01)
*B41J 2/17* (2006.01)

(52) U.S. Cl.
USPC ..... 347/85; 347/84; 347/88

(58) Field of Classification Search
CPC ..... B41J 2/17513; B41J 2002/14435; B41J 2/175
USPC ..... 347/84, 85, 88
See application file for complete search history.

(56) References Cited

U.S. PATENT DOCUMENTS

| | | | |
|---|---|---|---|
| 4,892,779 | A | 1/1990 | Leatherman et al. |
| 5,025,270 | A | 6/1991 | Umezawa |
| 5,561,453 | A | 10/1996 | Shibata et al. |
| 5,623,292 | A | 4/1997 | Shrivastava et al. |
| 5,691,754 | A | 11/1997 | Ta |
| 5,861,896 | A | 1/1999 | Barton et al. |
| 5,988,801 | A | 11/1999 | Coiner |
| 6,331,352 | B1 | 12/2001 | Bradley et al. |
| 6,514,599 | B1 | 2/2003 | Ali et al. |
| 6,557,987 | B1 | 5/2003 | Shibata et al. |
| 6,575,547 | B2 | 6/2003 | Sakuma |
| 6,886,926 | B2 | 5/2005 | Kaga et al. |
| 6,926,395 | B2 | 8/2005 | Okuyama |
| 7,011,399 | B2 | 3/2006 | Godil et al. |
| 7,410,248 | B2 | 8/2008 | Umeda et al. |
| 7,568,795 | B2 | 8/2009 | Freitag et al. |
| 7,611,236 | B2 | 11/2009 | Park |
| 2008/0055377 | A1 | 3/2008 | Jones et al. |
| 2008/0149189 | A1 | 6/2008 | Jones et al. |

*Primary Examiner* — Jannelle M Lebron
(74) *Attorney, Agent, or Firm* — Maginot, Moore & Beck, LLP

(57) ABSTRACT

A liquid ink transport assembly mitigates the migration of ink dye from one conduit in a plurality of conduits to another conduit in the plurality of conduits. The liquid ink transport assembly includes a plurality of conduits, each conduit in the plurality having a first end and a second end, the conduits in the plurality being arranged in a parallel configuration with at least one conduit being spatially separated from an adjacent conduit by a first distance that is greater than a second distance spatially separating other conduits in the plurality of conduits, and a heater, the plurality of conduits being positioned proximate to a first side of the heater to enable the heater to heat ink being carried between the first and the second ends of the plurality of conduits.

11 Claims, 7 Drawing Sheets

HEATED INK DELIVERY SYSTEM

PRIORITY CLAIM

This application claims priority to commonly-assigned U.S. patent application Ser. No. 12/700,413, which is entitled "A Heated Ink Delivery System," was filed on Feb. 4, 2010, and which issued as U.S. Pat. No. 8,469,497 on Jun. 25, 2013.

CROSS-REFERENCE TO RELATED APPLICATIONS

Reference is made to commonly-assigned U.S. patent application Ser. No. 11/511,697, which was filed on Aug. 29, 2006, which is entitled "System And Method For Transporting Fluid Through A Conduit" and which issued as U.S. Pat. No. 8,186,817 on May 29, 2012; Ser. No. 11/644,617, which was filed on Dec. 22, 2006, and which issued as U.S. Pat. No. 7,568,795 and is entitled "Heated Ink Delivery System"; and Ser. No. 12/271,998, which was filed on Nov. 17, 2008, which is entitled "An Ink Umbilical Interface To A Printhead In A Printer", and issued as U.S. Pat. No. 8,083,333 on Dec. 27, 2011, the disclosure of all of which are hereby expressly incorporated in their entireties herein.

TECHNICAL FIELD

This disclosure relates generally to machines that pump fluid from a supply source to a receptacle, and more particularly, to machines that move thermally treated fluid from a supply through a conduit to a printhead.

BACKGROUND

Fluid transport systems are well known and used in a number of applications. For example, heated fluids, such as melted chocolate, candy, or waxes, may be transported from one station to another during a manufacturing process. Other fluids, such as milk or beer, may be cooled and transported through conduits in a facility. Viscous materials, such as soap, lubricants, or food sauces, may require thermal treatment before being moved through a machine or facility.

One specific application of transporting a thermally treated fluid in a machine is the transportation of ink that has been melted from a solid ink stick in a phase change printer. Solid ink or phase change ink printers conventionally use ink in a solid form, either as pellets or as ink sticks of colored cyan, yellow, magenta and black ink, that are inserted into feed channels through openings to the channels. Each of the openings may be constructed to accept sticks of only one particular configuration. Constructing the feed channel openings in this manner helps reduce the risk of an ink stick having a particular characteristic being inserted into the wrong channel. Exemplary systems for delivering solid ink sticks in a phase change ink printer in this manner are well known.

After the ink sticks are fed into their corresponding feed channels, they are urged by gravity or a mechanical actuator to a heater assembly of the printer. The heater assembly includes a heater that converts electrical energy into heat and a melt plate. The melt plate is typically formed from aluminum or other lightweight material in the shape of a plate or an open sided funnel. The heater is proximate to the melt plate to heat the melt plate to a temperature that melts an ink stick coming into contact with the melt plate. The melt plate may be tilted with respect to the solid ink channel so that as the solid ink impinging on the melt plate changes phase, it is directed to drip into the reservoir for that color. The ink stored in the reservoir continues to be heated while awaiting subsequent use.

Each reservoir of colored, liquid ink may be fluidly coupled to a printhead through at least one manifold pathway. As used herein, liquid ink refers to solid ink that has been heated so it changes to a molten state or liquid ink that may benefit from being elevated above ambient temperature. The liquid ink is pulled from the reservoir as the printhead demands ink for jetting onto a receiving medium or image drum. The printhead elements, which are typically piezoelectric devices, receive the liquid ink and expel the ink onto an imaging surface as a controller selectively activates the elements with a driving voltage. Specifically, the liquid ink flows from the reservoirs through manifolds to be ejected from microscopic orifices by piezoelectric elements in the printhead. To provide differently colored inks to a printhead, each color of ink flows through a conduit, and the conduits may be grouped together into an ink umbilical assembly. As used herein "fluidly coupled to a printhead" refers to a fluid path being completed to a manifold, pressure chamber, or other receptacle for ink within a printhead prior to ejection of the ink from the printhead.

Typical prior art umbilical assemblies include one or more tubes arranged parallel to one another. For example, in a typical color printer four (4) tubes may be arranged in parallel, each carrying one ink of cyan, magenta, yellow, or black color. Some umbilical assemblies have more than one set of tubes leading to one or more printheads, for example, an eight tube umbilical could have two (2) tubes for each of the ink colors mentioned above. Many factors restrict the overall width of the ink umbilical, such as reservoir and printhead connections, routing requirements, space allocation, flexure for printhead travel, thermal efficiency in maintaining operation temperature, advantages in rapid warm up, and advantages with minimal system level molten ink volumes. Complementary to most of these objectives, the walls of each umbilical are typically relatively thin. The thin walls help conserve space, enhance flexibility, and allow more efficient heating of the ink in the tube so that it remains fluid or can be re-melted. Typical umbilical assemblies are extruded from silicone, which may be extruded into thin flexible tubes, which may also be extruded as a connected cluster of tubes or other side-by-side arrangements.

In some liquid inkjet printers, silicone umbilical tubes have been observed to allow ink components in the ink to seep through the tube wall. This seeping ink may be able to migrate to and enter an adjacent tube. In some cases, these migratory components may include ink dye. The dye may enter the adjacent tube in sufficient quantities to impact the quality of the colored ink carried in that tube. Consequently, image hues may shift as a result of the mixture of ink dyes within a conduit carrying ink to a printhead. The chemical compositions of certain colors of ink also affect migration, with some inks having a substantially higher rate of migration, while other colors have very little migration. Since silicone or other unintentionally permeable elastomers are common materials used in tubes carrying various types of fluid, particularly heated fluids, the problem of fluid migration could occur in other fields beyond printing where fluids are transported through tubes susceptible to migration. Descriptions herein of tube permeability are relative to the small molecular size of dye materials and potentially other fluid constituents. The tubes are not permeable in the more common term use as general leakage cannot occur. Chemical compatibility can be an issue between some fluids and elastomer type materials.

Proposed solutions for colored ink migration have disadvantages. One solution is to form the umbilical from a material that has little or no susceptibility to fluid migration, such as stainless steel or aluminum. While these materials effectively hinder ink dye migration, they lack the flexibility required for an umbilical that moves with a printhead on a carriage that traverses a printing media. Alternative elastomeric materials exhibit permeability to some degree, may be difficult to extrude into tubes having appropriate dimensions for a particular printer, and may become brittle over time when heated and cooled during the printer's operation. Other proposed solutions to ink migration may require tubes that are too thick to fit into the restricted spaces present in the printhead. An umbilical that mitigates the problems of fluid migration while also remaining thin and flexible benefits the fields of printing and fluid transportation systems. Additionally and critical to any valid solution, the umbilical must be cost effective and practical to fabricate and control thermally.

SUMMARY

A liquid ink transport assembly mitigates the migration of ink colorant from one conduit in a plurality of conduits to another conduit in the plurality of conduits. The ink transport assembly includes a plurality of conduits, each conduit in the plurality having a first end and a second end, the conduits in the plurality being arranged in a parallel configuration with at least one conduit being spatially separated from an adjacent conduit by a first distance that is greater than a second distance spatially separating other conduits in the plurality of conduits, and a heater, the plurality of conduits being positioned proximate to a first side of the heater to enable the heater to heat ink being carried between the first and the second ends of the plurality of conduits.

The liquid ink transport assembly may be used in an ink delivery system for transporting ink to a printhead. The ink delivery assembly includes a plurality of ink reservoirs, each reservoir containing an ink having a colorant that is differently colored than a colorant in the ink in the other ink reservoirs of the plurality of ink reservoirs, a plurality of conduits, each conduit in the plurality of conduits having an inlet and each inlet is fluidly coupled to only one of the reservoirs and each of the reservoirs is fluidly coupled to one of the conduit inlets, the conduits in the plurality of conduits being arranged in a parallel configuration with a first conduit being spatially separated from a second adjacent conduit by a distance that is greater than a distance spatially separating the second adjacent conduit from a third conduit that is adjacent to the second adjacent conduit, a heater, the plurality of conduits being positioned proximate to a first side of the heater to enable the heater to heat ink being carried through the conduits of the plurality of conduits, and a printhead fluidly coupled to each conduit of the plurality of conduits to enable the printhead to receive all colors of ink contained in the plurality of reservoirs.

Another embodiment of an ink delivery assembly also reduces the flow of ink colorant from a conduit transporting ink. The ink delivery assembly includes a plurality of ink reservoirs, each reservoir containing an ink having a colorant that is different than a colorant in the ink in the other ink reservoirs of the plurality of ink reservoirs, a plurality of conduits, each conduit in the plurality of conduits having an inlet and each inlet is fluidly coupled to only one of the reservoirs and each of the reservoirs is fluidly coupled to only one of the conduit inlets, at least one conduit in the plurality of conduits having a coating within the conduit that is resistant to ink dye flowing through a wall of the conduit, a heater, the plurality of conduits being fluidly coupled to a first side of the heater to enable the heater to heat ink being carried through the conduits of the plurality of conduits, and a printhead fluidly coupled to each conduit of the plurality of conduits to enable the printhead to receive all colors of ink contained in the plurality of reservoirs.

BRIEF DESCRIPTION OF THE DRAWINGS

The foregoing aspects and other features of an fluid transport apparatus and an ink imaging device incorporating a fluid transport apparatus are explained in the following description, taken in connection with the accompanying drawings, wherein.

DETAILED DESCRIPTION

Figure 1:
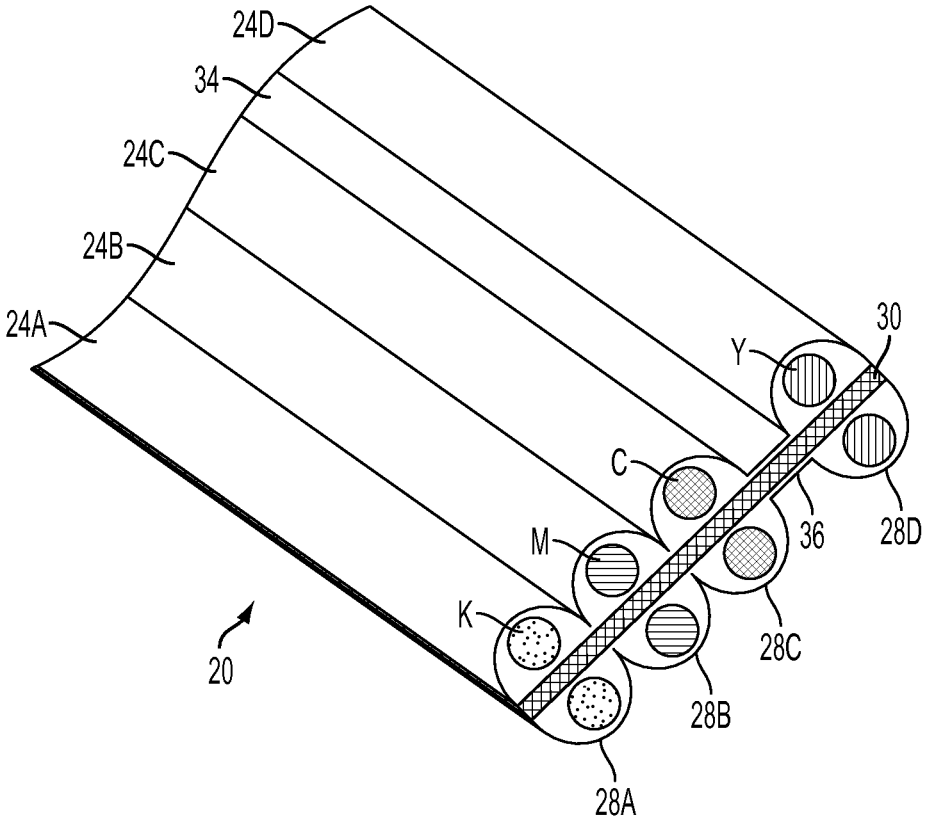
FIG. 1 is an enlarged perspective view of an ink umbilical used to connect an ink reservoir to a printhead.

For a general understanding of the environment for the system and method disclosed herein as well as the details for the system and method, reference is made to the drawings. In the drawings, like reference numerals have been used throughout to designate like elements. As used herein, the word "umbilical assembly" refers to a plurality of conduit groupings that are assembled together in association with a heater to maintain the ink in each plurality of conduits at a temperature different than the ambient temperature. The term "conduit" refers to a body having a passageway through it for the transport of a liquid or a gas. Also, printhead, as used herein, may include, in addition to inkjet ejectors, any hardware, manifold, or the like that retains ink prior to ejection from the inkjet ejectors.

An ink umbilical 20 configured to reduce the migration of ink between a first conduit and a second conduit is depicted in FIG. 1. The ink umbilical 20 includes a grouping of a first set of conduits 24A, 24B, 24C, and 24D and a second set of conduits 28A, 28B, 28C, and 28D. As used herein a "set" of conduits is a collection of conduits that belong together, such as the four conduit set that carries the four colors typically used in a color printer and a "grouping" refers to a convenient, but perhaps, temporary gathering of multiple sets. Each conduit in the ink umbilical 20 may be an extruded silicone tube. Sandwiched between the first and the second set of conduits is a heater 30. In the example embodiment of FIG. 1, the conduits are extruded in a single structure which forms a flexible sheet disposed underneath each conduit. In an alternative embodiment, each set of conduits may be comprised of independent conduits that are attached together at each end of the conduits in a set so the conduits are generally parallel to one another along the length of the ink umbilical. The conduits are preferably semi-circular to provide a relatively flat surface that facilitates the joining of the conduits to a heater as described in more detail below. This structure promotes transfer of heat into the tubes. Additionally, placing conduits on both sides of the heater makes efficient use of the heater. This configuration also provides thermal mass around the heater to improve heat spread and to reduce the likelihood of hot spots and excessively high skin temperatures behind the external insulation jacket.

Each conduit in each set of conduits is fluidly coupled at an inlet end to a color ink reservoir and at an outlet end to a printhead. This enables the color conduit lines to remain grouped up to the point where they connect, which helps maintain thermal efficiency. As used herein, coupling refers to both direct and indirect connections between components. All of the outlet ends of a set of conduits are fluidly coupled to the same printhead to provide a set of four ink colors to the printhead for color printing in the example being discussed. As shown in FIG. 1, conduits 24A and 28A are fluidly coupled to the black ink reservoir, conduits 24B and 28B are fluidly coupled to the magenta ink reservoir, conduits 24C and 28C are fluidly coupled to the cyan ink reservoir, and conduits 24D and 28D are fluidly coupled to the yellow ink reservoir.

In the embodiment of FIG. 1, conduit 24D is separated by a spacer 34 from conduit 24C so the distance between conduits 24D and 24C is greater than the distance between conduits 24A, 24B, and 24C. Similarly, spacer 36 separates conduits 28C and 28D with a distance that is greater than the distance between conduits 28A, 28B, and 28C. The spacers 34 and 36 in FIG. 1 are extruded with the conduits. In the embodiment of FIG. 1, spacers 34 and 36 are approximately 1 mm in width, which is sufficient to reduce migration while also keeping the total width of ink umbilical 20 narrow enough to be functional. In FIG. 1, spatially separated conduits 24D and 28D are chosen to carry yellow ink because yellow phase change ink, in its current formulation, has been observed to migrate through silicone tubes more easily than other phase change ink colors. Other embodiments may separate one or more conduits in a conduit set by varying distances related to the propensity of the ink dyes in the various conduits to seep through the conduits. Alternatively, other arrangements of the conduits may be used as well.

The heater 30 includes an electrical resistance that may be in the form of a resistive heater tape or wire that generates heat in response to an electrical current flowing through the heater. The heater elements may be covered on each side by an electrical insulation having thermal properties that enable the generated heat to reach the conduits in adequate quantities to maintain melted phase change ink or other liquid ink in the conduits at an appropriate temperature. In one embodiment, the heater 30 is a Kapton® heater made in a manner described in more detail below. Alternate heater materials and constructions, such as a silicone heater, may be used for different temperature environments, or to address cost and geometry issues for the construction of other embodiments of umbilical assemblies.

The heater 30, in one embodiment, has multiple zones with each zone generating a particular watt-density. The heater may be formed by configuring serpentine resistive heating traces on a non-conductive substrate or film. The serpentine resistive heating traces may be formed with INCONEL®, which is available from known sources. The watt-density generated by the heating traces is a function of the geometry and number of traces in a particular zone as well as the thickness and width of the INCONEL® traces. After the heating traces are appropriately configured for the desired watt-density, a pair of electrical pads, each one having a wire extending from it, is electrically coupled to the heating traces. The wires terminate in connectors so an electrical current source may be electrically coupled to the wires to complete a circuit path through the heating traces. The current causes the heating traces to generate heat. The substrate on which the heating traces are placed may then be covered with an electrical insulation material, such as Kapton®. The electrical insulation material may be bonded to the substrate by an adhesive, such as PSA, or by mechanical fasteners. Accordingly, the heater is an assemblage of multiple layers of materials that may comprise one or more layers of a substrate, heating element, adhesive, thermal conducting member, and insulation material.

To keep the heater 30 from self-destructing from high localized heat, the heater may be electrically coupled to a thermally conductive strip to improve thermal uniformity along the heater length. The thermal conductor may be a layer or strip of aluminum, copper, or other thermally conductive material that is placed over the electrically insulated heating traces. The thermal conductor provides a highly thermally conductive path so the thermal energy is spread quickly and more uniformly over the mass. The rapid transfer of thermal energy keeps the trace temperature under limits that would cause or result in damage, preventing excess stress on the traces and other components of the assembly. Less thermal stress results in less thermal buckling of the traces, which may cause the layers of the heater to delaminate. In one embodiment, the heater may be formed as a layer stack-up with the following layers from an upper surface of the heater to its lower surface: Kapton® pressure sensitive adhesive (PSA), aluminum foil, fluorinated ethylene-propylene (FEP), Kapton® FEP, INCONEL® FEP, aluminum foil, and Kapton® PSA. Thus, the material stack-up for this embodiment is symmetrical about the INCONEL® traces, although other configurations and materials may be used.

After the heater 30 has been constructed, it has an upper side and a lower side, both of which are relatively flat. One set of conduits is applied to the upper side of the heater 30. The set of conduits may be adhesively bonded to the heater using a double-sided pressure sensitive adhesive (PSA). Likewise, the other set of conduits are bonded to the lower side of the heater 30. This construction enables the two sets of conduits to share a heater that helps maintain the ink within the conduits in the liquid state. In one embodiment, the heater is configured to generate heat in a uniform gradient to maintain ink in the conduits within a temperature range of about 100 degrees Celsius to about 140 degrees Celsius. The heater 30 may also be configured to generate heat in other temperature ranges. The heater is capable of melting ink that has solidified within an umbilical, as may occur when turning on a printer from a powered down state.

Figure 2:
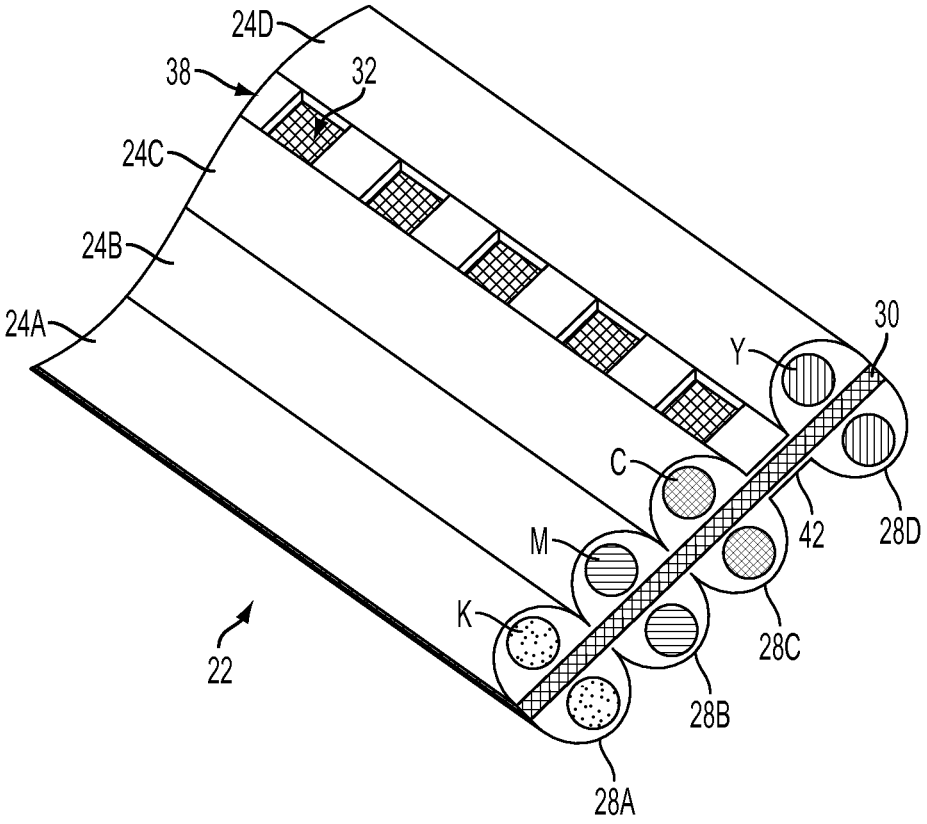
FIG. 2 is an enlarged perspective view of an alternative ink umbilical used to connect an ink reservoir to a printhead.

An alternative embodiment 22 of the ink umbilical of FIG. 1 is depicted in FIG. 2. Using like reference numbers to identify like structures, the ink umbilical of FIG. 2 has a first set of conduits 24A, 24B, 24C, and 24D and a second set of conduits 28A, 28B, 28C, and 28D as FIG. 1. As in FIG. 1, a heater 30 is positioned between the two sets of conduits. In FIG. 2, conduits 24C and 24D and conduits 28C and 28D are separated by perforated spacers 38 and 42. Each perforated spacer has a series of gaps formed through its surface. FIG. 2 depicts these gaps 32 through the surface of spacer 38, and a similar set of gaps (not shown) is formed through spacer 42.

The gaps may be of any appropriate shape and size. The gaps may leave sufficient connecting material to secure conduits 28C and 28D to the ink umbilical 22, while further reducing the surface area of the material between conduits 24C and 24D and conduits 28C and 28D. The reduced surface area provides less material for the migration of ink between adjacent conduits. In the embodiment of FIG. 2, the heater 30 is a continuous layer that is exposed by the gaps, but it is envisioned that alternative heater embodiments could have additional gaps aligned with the gaps 32 through the spacers 38 and 42. In one embodiment, the gap extends the length of the conduit set to enable one or more conduits of the conduit set to be completely isolated from the remaining conduits in the conduit set.

Figure 3:
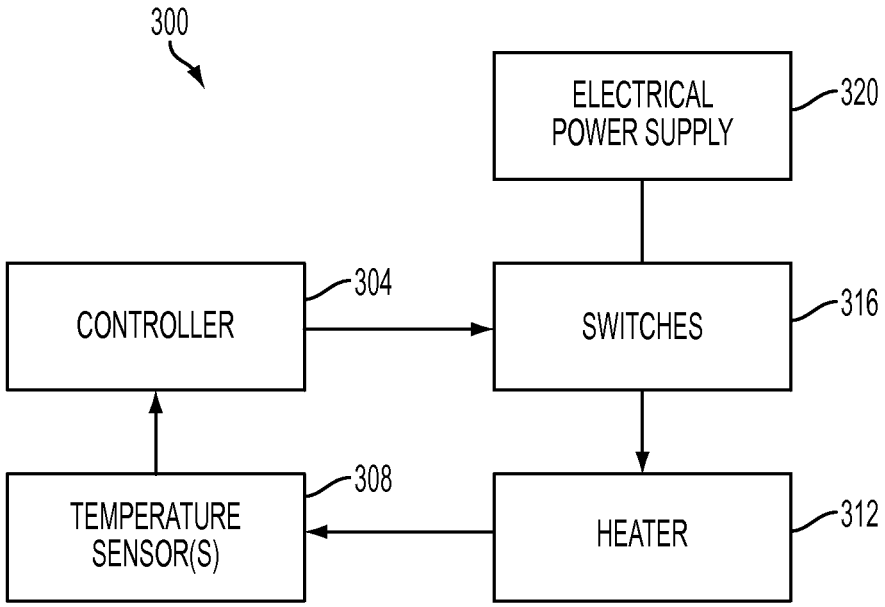
FIG. 3 is a block diagram of a sensor and control system that control a heater which may be adapted for use with the ink umbilicals of FIG. 1 and FIG. 2.

A block diagram of a control system 300 capable of operating heater 30 is depicted in FIG. 3. The controller 304 receives input data signals from temperature sensor 308 and in response to those signals sends output signals to open or close switch 316. The controller is a form of an electronic control unit, typically including a microprocessor such as an ASIC, FPGA, a general purpose CPU, such as a CPU from the ARM family, or any data processing device adapted to receive and process data from one or more temperature sensors 308 and to send signals to switch 316. The controller may also be an existing processing unit in a printer that is further configured to the controller of FIG. 3. Controllers are configured by coupling the processor to the requisite conductors and electronic components to perform a function and by storing programmed instructions in a memory that is accessed by the processor to execute a program.

The temperature sensors 308 are typically disposed on the heater 312. In the case of heater 30 shown in FIG. 1 and FIG. 2, multiple temperature sensors are preferable to record the temperature at each independent zone in heater 30. In the embodiment of FIG. 3, the temperature sensors 308 are thermistors, but alternative temperature sensors, including platinum resistance thermometers, silicon bandgap temperature sensors, or thermocouples, may be used. The switch 316 is typically a solid-state switch such as a power MOSFET that opens or closes an electrical circuit connecting electrical power supply 320 to the heater 312 in response to a signal from controller 304. In the case of a heater 312 having multiple temperature zones, each zone may have an individual switch 316 connecting the zone to the electrical power supply 320, and controller 304 is configured to open and close each switch 316 selectively.

Figure 4:
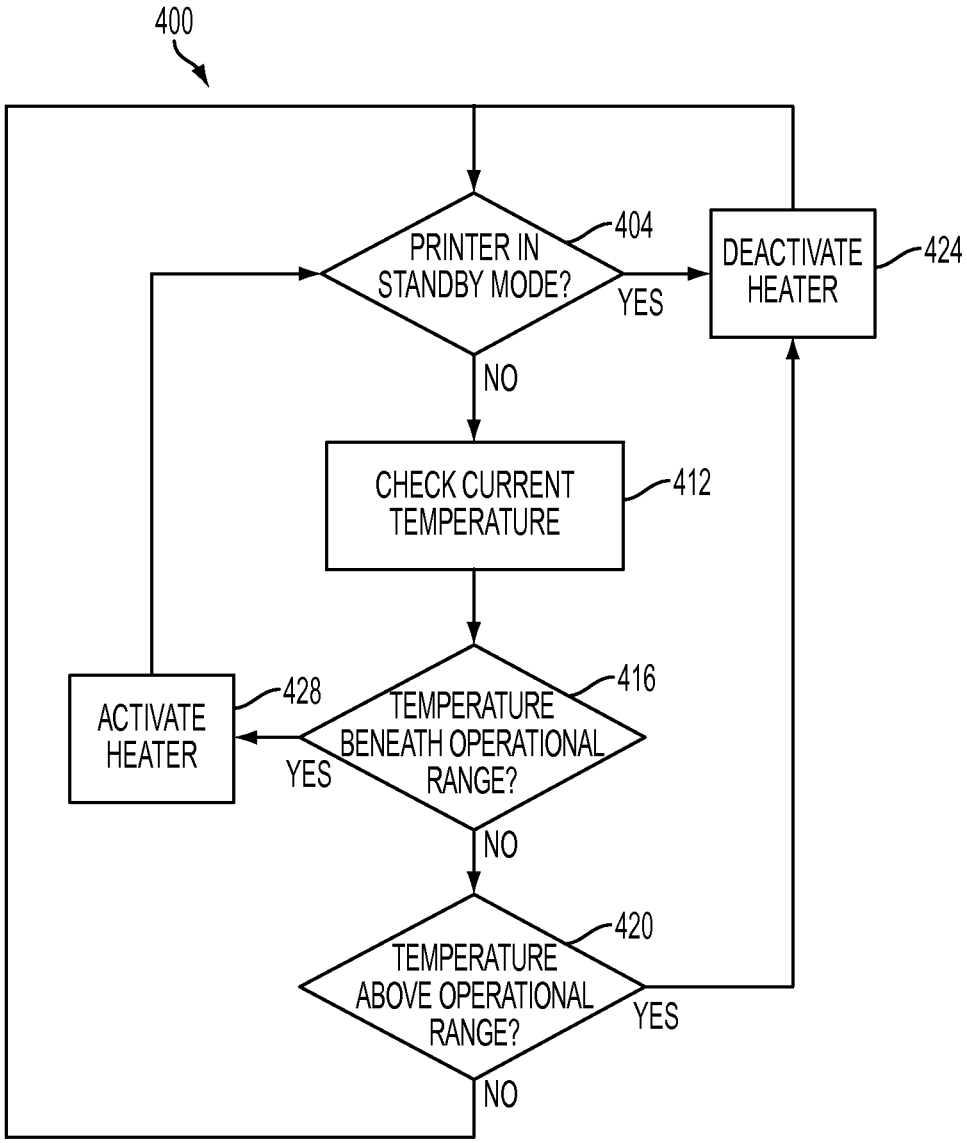
FIG. 4 is a block diagram of an example process that may be used by the control system of FIG. 3 for controlling the heating of the umbilicals of FIG. 1 and FIG. 2.

An example process 400 that may be used with controller 300 is depicted in FIG. 4. This process exemplifies use with known phase change inks and their current formulations. Other temperature ranges and timing variations may be used for fluids with different formulations and characteristics. The process begins with the controller determining if the printing device is in a standby mode (block 404). Standby mode is a power saving mode that typically occurs when the printer has not been used for a predetermined length of time, or when a user manually places the printer into standby mode. If the printer is in standby mode, the controller deactivates the heater (block 424).

If the printer is not in standby mode, the controller next checks the temperature detected by the temperature sensor (block 412). In the embodiments described herein, the maximum operating temperature range is between approximately 95° C. and 150° C., while the preferred temperature ranges are between approximately 105° C. and 115° C. The controller interprets the received temperature data and responds according to predetermined temperature threshold parameters. If the current temperature is below the desired floor threshold (block 416), then the heater is activated (block 428), and the process returns to block 404. If the heater is already activated while the temperature is below the floor threshold, it remains activated. This situation may occur during a warm-up sequence. In a solid ink printing system, other operational aspects of the printer may be suspended if the temperature is too low since this may indicate that the ink has solidified and will not flow properly. The selective heating of ink only when the printer is operational and the preferred operating temperature ranges reduce migration since ink at higher temperatures migrates between conduits more easily than ink at lower temperatures.

If the current temperature is not below the predetermined threshold, then the controller determines if the temperature is above a second ceiling temperature threshold for the maximum temperature (block 420). If the ceiling temperature is exceeded, the heater is deactivated (block 424), and the process returns to block 404. This situation occurs when the heater has been running and the temperature has exceeded the ideal operational range. In typical operation, the printer may continue other operations as the ink conduits will begin to cool and return to the desired operating range once the heater is deactivated. If the temperature is not above the second ceiling threshold, the process 400 returns to block 404.

The process 400 of FIG. 4 may be employed at more than one location along the heater. An example embodiment could employ a heater that has multiple independent heating zones where at least one temperature sensor detects temperatures from each zone. In this case, the process of FIG. 4 could be applied to each heating zone independently to electrically couple or decouple the heater from electric current in each zone.

Figure 5:
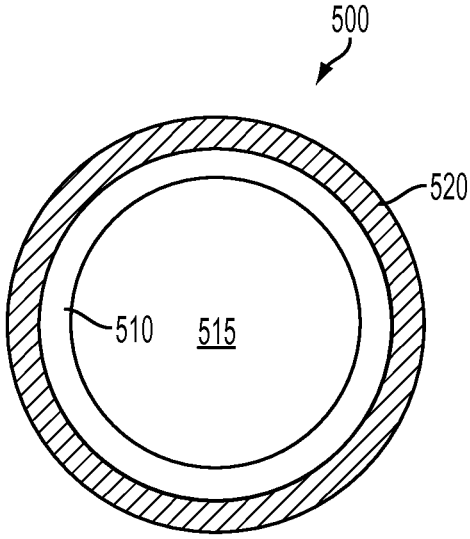
FIG. 5 is a cross sectional view of an ink conduit surrounded by a sheath that is resistant to ink constituent flow.

Another conduit structure 500 for reducing ink migration is depicted in FIG. 5. The conduit structure 500 includes a conduit wall 510 and an outer sheath 520. The conduit wall 510 may be formed from extruded silicone as discussed above. The conduit wall 510 surrounds a lumen 515 that allows ink to flow through the conduit. The outer sheath 520 is formed from a material that is resistant to flow of a constituent in the fluid carried by the conduit, and the outer sheath 520 wraps around the outer portion of conduit wall 510. Consequently, any fluid constituent seeping through the conduit wall 510 is blocked from further migration. For example, Kapton®, parylene coating, or Gore-Tex® material may be used for such a sheath around conduits carrying melted phase change ink. The outer sheath 520 of FIG. 5 may be employed with conduits used in existing ink umbilicals, or with the ink umbilicals 20 and 22 shown in FIG. 1 and FIG. 2.

Figure 6:
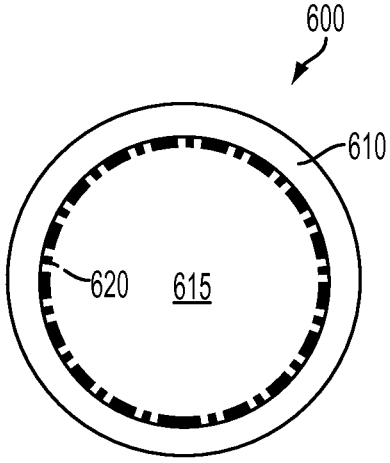
FIG. 6 is a cross sectional view of an ink conduit with an interior surface coating that is resistant to ink constituent flow.

Another conduit structure 600 for reducing ink migration is depicted in FIG. 6. The conduit structure 600 includes a conduit wall 610 and a coating 620. The conduit wall 610 may be formed from extruded silicone as discussed above. The coating 620 on the conduit wall 610 surrounds the lumen 615 through which ink flows. The coating 620 is formed from a material that is resistant to flow of a constituent of the fluid carried by the conduit, and may be applied to the interior of conduit wall 610 through a dipping or a deposition process. For example, parylene coating may be used or Gore-Tex® material may be co-extruded with the conduit material to form an inner coating for the conduit lumen. The coating 620 of FIG. 6 may be employed with conduits used in existing ink umbilical assemblies, or with the ink umbilical assemblies 20 and 22 shown in FIG. 1 and FIG. 2. Additionally, another possible conduit structure includes both the inner coating 620 and the outer sheath 520 of FIG. 5 with an elastomeric conduit.

Figure 7:
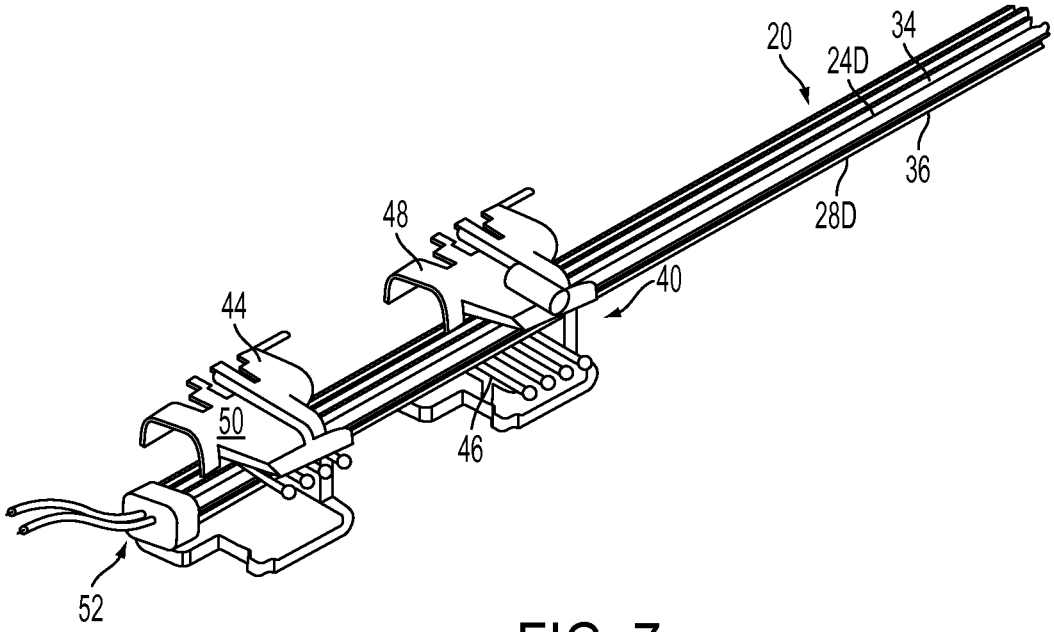
FIG. 7 is a partially exploded view of the ink umbilical shown in FIG. 1 having two printhead connections.

FIG. 7 shows the ink umbilical 20 having two printhead connectors 40, 50 fluidly coupled to it. The printhead connectors, in one embodiment, include rigid plastic housings 44 and 48. Within each housing is a plurality of ink nozzles, one nozzle for each conduit in a set of conduits. The ink nozzles 46 of the printhead connector 40 are fluidly coupled to the conduits in the first set of conduits in the umbilical assembly 20 and the ink nozzles of the printhead connector 50 are fluidly coupled to the conduits in the second set of conduits in the umbilical assembly 20. The ink nozzles may be fabricated from aluminum and constructed with an integrated barb at each end. The barbs, which provide a positive seal press fit, are pushed into a conduit to enable flow from a conduit through the nozzle. In the embodiment of FIG. 7, the barbs corresponding to the ink conduits 24D and 28D of FIG. 1 are positioned to couple fluidly with those conduits in the spatially separated position where the conduits are separated by spacers 34 and 36. The silicone tubing, in one embodiment, stretches tightly over the barb to form a seal. The ink nozzles of the printhead connector 40 may be fluidly coupled to one of the printheads in a printer while the ink nozzles of the printhead connector 50 may be fluidly coupled to another one of the printheads in the printer. In this manner, a grouping in a single ink umbilical assembly having multiple conduit sets provides a set of colored ink from the color ink reservoirs to two printheads. The ink umbilical shown in FIG. 7 includes an electrical connection 52 at its terminating end for coupling an electrical current source to the heater 30.

Figure 8:
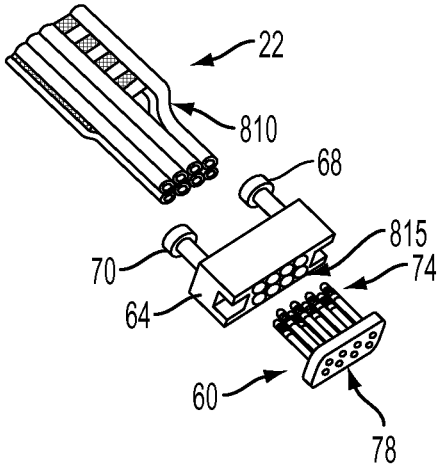
FIG. 8 is a partially exploded view of a reservoir connection for coupling the ink umbilical of FIG. 2 to an ink reservoir.

FIG. 8 shows an exploded view of a reservoir connector 60 for fluidly coupling the ink umbilical assembly 22 to each of the color ink reservoirs. The reservoir connector 60, in one embodiment, includes a rigid plastic housing 64, a pair of fasteners 68, 70 for coupling the connector to a reservoir structure (not shown), a set of ink nozzles 74 for each set of conduits in the umbilical assembly 22, and a gasket 78. The umbilical assembly 22 may have an inward taper shown at 810 that allows the umbilical 22 to mate with the plastic housing 64 that has evenly spaced mating holes 815. Alternatively, housing 64 may arrange the mating holes 815 to correspond to the distances separating the conduits to enable an umbilical as shown in FIG. 1 to mate with the housing without needing to taper to an evenly spaced mating interface. Once mated, the plastic housing 64 provides a barrier between the conduits that prevents ink migration at the coupling location.

The connector 60 shown in FIG. 8 includes only one set of ink nozzles to facilitate viewing of the connector's structure. Each set of ink nozzles 74 includes an ink nozzle for each conduit in one grouping of two sets of conduits. One end of each ink nozzle in the set of ink nozzles in the reservoir connector 60 is fluidly coupled to one of the conduits in the grouping of the two conduit sets in the umbilical assembly 22. The other end of each ink nozzle in a set of ink nozzles in the reservoir connector 60 is fluidly coupled to one of the color ink reservoirs. The integrated barbs, noted above, enable appropriate coupling of the ink nozzles to the conduits. The gasket 78 becomes clamped between the barb housing 64 and a planar surface within the mating ports in the reservoir connection region to facilitate the seal between ports and components when fasteners 68 and 70 are installed. In this manner, the inlets for each set of conduits in the ink umbilical 22 are fluidly coupled to all of the colors in the color ink reservoirs.

Figure 9:
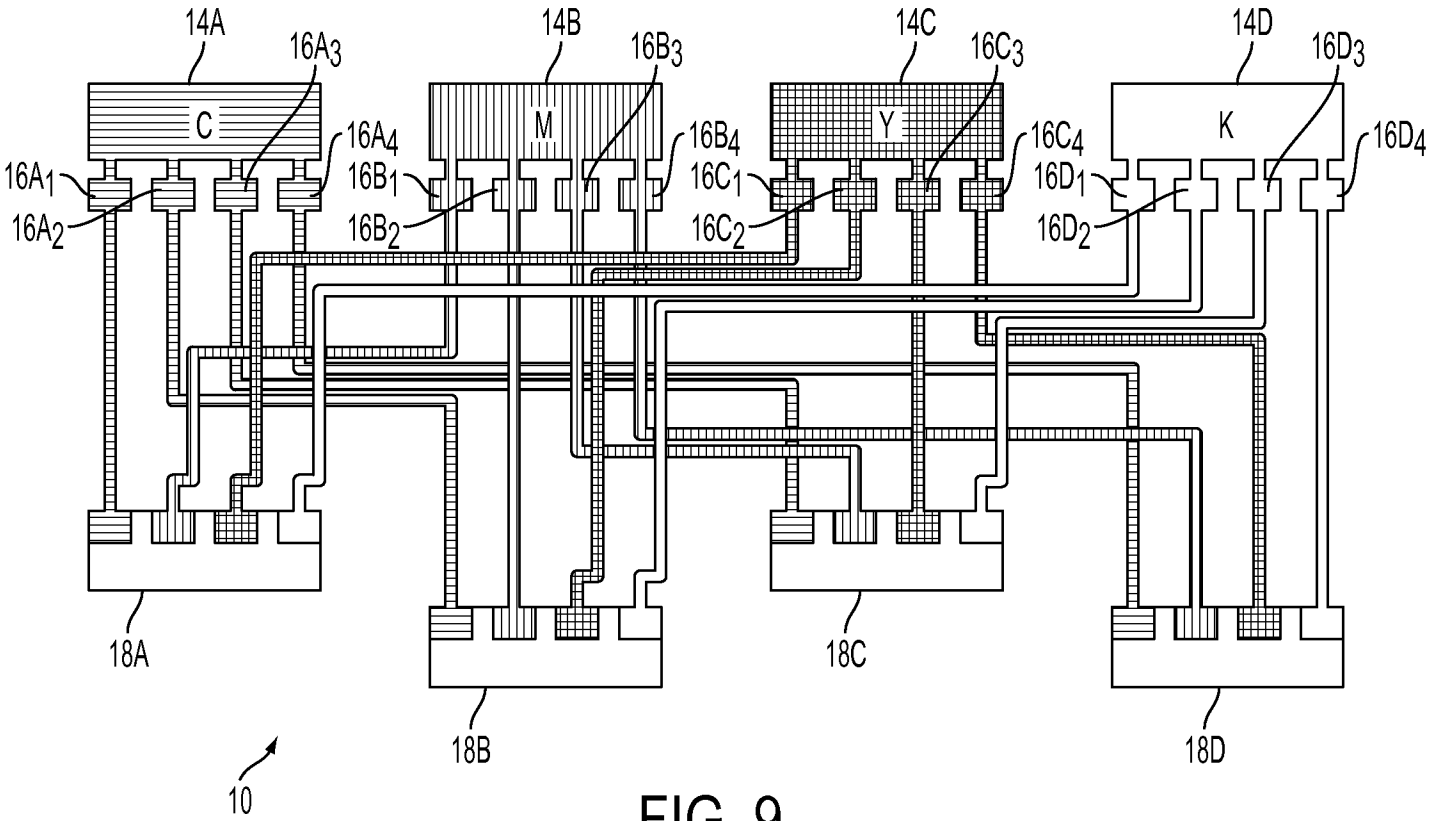
FIG. 9 is a block diagram of connections for an ink delivery system in a phase change ink printer adapted to use the ink umbilicals of FIG. 1 and FIG. 2.

A block diagram of the connections for a liquid ink delivery system that may be incorporated within such a printer is shown in FIG. 9. Four printheads are illustrated, but fewer or more printheads may be used. The system 10 includes reservoirs 14A, 14B, 14C, and 14D that are fluidly coupled to printheads 18A, 18B, 18C, and 18D through staging areas 16$A_{1-4}$, 16$B_{1-4}$, 16$C_{1-4}$, and 16$D_{1-4}$, respectively. In practice, the ink staging or transfer areas are located for convenient umbilical assembly connection. Each reservoir collects melted ink for a single color. As shown in FIG. 9, reservoir 14A contains cyan colored ink, reservoir 14B contains magenta colored ink, reservoir 14C contains yellow colored ink, and reservoir 14D contains black colored ink. FIG. 9 shows that each reservoir is fluidly coupled to each of the printheads to deliver the colored ink stored in each reservoir. Consequently, each printhead receives each of the four colors: black, cyan, magenta, and yellow, although other colors, including monochrome shades, may be used for other types of printers. The melted ink is held in the high pressure staging areas where it resides until a printhead requests additional ink. The spatial relationship between reservoirs and printheads are shown in close proximity in the schematic such that the run length of parallel grouping is not illustrated.

FIG. 9 emphasizes connection points for a plurality of overlapping conduits between the reservoirs and the printheads. While independent conduit lines may be used to couple the reservoirs fluidly to each of the printheads, such a configuration is inefficient for routing and retention. Actual distances between the reservoirs and heads are much longer. Also, the longest conduit lines, such as the one between the black ink reservoir 14D and the printhead 18A, for example, may be sufficiently long that under some environmental conditions the ink may solidify before it reaches its target printhead. Conduits must be flexibly configured and attached to one another to allow relative motion for printer operation and reasonable service access. The umbilical assemblies 20 and 22 shown in FIG. 1, and FIG. 2 are flexible to enable relative movement between adjacent printheads and between printheads and reservoirs.

In operation, an ink umbilical has a reservoir connector mated to the inlet end of the umbilical at one end. Each ink nozzle in the reservoir connector is fluidly coupled to an ink reservoir and the connector is fastened to structure within the printer. A printhead connector is mounted about the umbilical proximate the inlets of a printhead. For an umbilical having two sets of conduits, another printhead connector is mounted about the umbilical proximate the inlets of the second printhead. The printhead connectors are then fluidly coupled to the respective printheads. An electrical current source is then electrically coupled to the electrical connector at the terminating end of the umbilical. A second ink umbilical assembly may be fluidly coupled to another two printheads and to the color ink reservoirs to provide ink to another pair of printheads.

Thereafter, ink pumped from the ink reservoirs enters the sets of conduits in an umbilical. A controller in the printer electrically couples the current source to the heater in the umbilical selectively and the heater generates heat for maintaining the ink in its liquid state. If the printer is in an operational mode, the heater is electrically coupled to the current source when the umbilical temperature is below the preferred temperature range to bring each ink umbilical to within the preferred temperature range. Ink from one set of conduits is delivered to the printhead fluidly coupled to them while ink from the other set of conduits is delivered to the printhead fluidly coupled to them. If the printer is in standby mode or if the preferred temperature range is exceeded, the heater is decoupled from the current source.

Measures of spatial separation and/or isolation of the conduits in a set of conduits to mitigate color mixing may be insufficient in some scenarios when particular attention is given to umbilical assembly cost and fabrication efficiency. In some embodiments, configuring the heater controller to regulate the temperature of the heater outside normally historical operation ranges has proved useful. Moderate temperature changes of molten ink in the implementation of the phase change ink umbilical assembly appear to have some effect on the rate of dye migration. Specifically, temperatures in the umbilical assembly were lowered to levels heretofore thought unacceptable and the time at that lower operational temperature were reduced based on operation state opportunities that would otherwise not have been deemed appropriate. Combining this temperature control with the spatially separated conduits in a set of conduits has provided a satisfactory level of dye migration control.

Those skilled in the art will recognize that numerous modifications can be made to the specific implementations of the ink umbilical described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A liquid ink transport assembly for transporting ink to a printhead comprising:

a plurality of conduits, each conduit in the plurality having a length between a first end and a second end, the conduits in the plurality being arranged to enable a substantial portion of the lengths of the conduits between the first and the second ends to be in parallel with one another, and a portion of the length between the first end and the second end of at least one conduit being spatially separated from a portion of a length between the first and the second end of an adjacent and parallel conduit by a first distance that is greater than a second distance spatially separating the lengths of other adjacent and parallel conduits in the plurality of conduits;

a heater, the plurality of conduits being positioned proximate a first side of the heater to enable the heater to heat ink being carried between the first and the second ends of the plurality of conduits; and a flexible sheet disposed underneath each conduit in the plurality of conduits, the flexible sheet having at least one opening in a portion of the flexible sheet between the portion of the length between the first end and the second end of the at least one conduit spatially separated from the adjacent and parallel conduit by the first distance and the portion of the length between the first end and the second end of the adjacent and parallel conduit.

2. The liquid ink transport assembly of claim 1 further comprising:

a sheath resistant to flow of an ink dye, the sheath surrounding the first conduit in the plurality of conduits.

3. The liquid ink transport assembly of claim 1 further comprising:

a coating resistant to flow of an ink dye within the first conduit in the plurality of conduits.

4. The liquid ink transport assembly of claim 1 wherein the conduits of the plurality of conduits are silicone tubes.

5. The liquid ink transport assembly of claim 1 further comprising:

a second plurality of conduits, each conduit in the second plurality having a first end and a second end, the conduits in the second plurality being arranged in a parallel configuration with first conduit being spatially separated from a second adjacent conduit by a distance that is greater than a distance spatially separating the second adjacent conduit from a third conduit that is adjacent to the second adjacent conduit, and the second plurality of conduits being positioned proximate a second side of the heater to enable the heater to heat ink carried between the first and the second ends of the conduits in the second plurality of conduits.

6. The ink delivery system of claim 1 further comprising:

a temperature sensor proximate the heater, the temperature sensor configured to generate a signal corresponding to a temperature of the heater.

7. The ink delivery system of claim 1, the heater further comprising:

an electrical resistive heater tape.

8. The ink delivery system of claim 1, the heater further comprising:

a serpentine resistive heating trace arranged on a non-conductive substrate.

9. The ink delivery system of claim 1 further comprising:

a thermal conductive layer interposed between the plurality of conduits and the heater.

10. The liquid ink transport assembly of claim 1, the flexible sheet further comprising:

a plurality of openings in the portion of the flexible sheet between the portion of the length between the first end and the second end of the at least one conduit spatially separated from the adjacent and parallel conduit by the first distance and the portion of the length between the first end and the second end of the adjacent and parallel conduit.

11. The ink delivery system of claim 10, wherein the openings in the flexible sheet expose the heater.

* * * * *